United States Patent [19]

Coburn

[11] Patent Number: 4,643,271

[45] Date of Patent: Feb. 17, 1987

[54] SOUND BARRIER

[75] Inventor: David E. Coburn, Cleveland Heights, Ohio

[73] Assignee: Thomas J. Kelley, Bay Village, Ohio

[21] Appl. No.: 683,230

[22] Filed: Dec. 18, 1984

[51] Int. Cl.[4] ..... E04H 17/00; G10K 11/00

[52] U.S. Cl. ..... 181/210; 181/284; 181/290

[58] Field of Search ..... 181/210, 284, 287, 290; 405/284

[56] References Cited

U.S. PATENT DOCUMENTS

| | | | |
|---|---|---|---|
| 3,630,310 | 12/1971 | Federer | 181/210 |
| 3,656,576 | 4/1972 | Gubela | 181/210 |
| 3,961,682 | 6/1976 | Dausch et al. | 181/290 |
| 4,040,212 | 8/1977 | Goransson | 181/287 X |
| 4,069,768 | 1/1978 | Matsumoto et al. | 181/210 X |
| 4,094,379 | 6/1978 | Steinberger | 181/210 X |
| 4,095,669 | 6/1978 | Bond, Sr. | 181/210 |
| 4,111,081 | 9/1978 | Hilliard et al. | 181/210 X |
| 4,156,476 | 5/1979 | Matsumoto et al. | 181/210 |
| 4,158,401 | 6/1979 | Matsumoto et al. | 181/210 |

FOREIGN PATENT DOCUMENTS

| | | | |
|---|---|---|---|
| 2917414 | 11/1980 | Fed. Rep. of Germany | 181/210 |
| 0646221 | 11/1984 | Switzerland | 181/210 |

*Primary Examiner*—Benjamin R. Fuller

*Attorney, Agent, or Firm*—D. Peter Hochberg

[57] ABSTRACT

A sound barrier for use along vehicle pathways including a gabion, the gabion comprising a wire cage filled with sound absorbing material and ballast material; gabions in the potential path of vehicles leaving the pathway have resilient filler material for cushioning the impact of vehicles striking the gabion.

1 Claim, 5 Drawing Figures

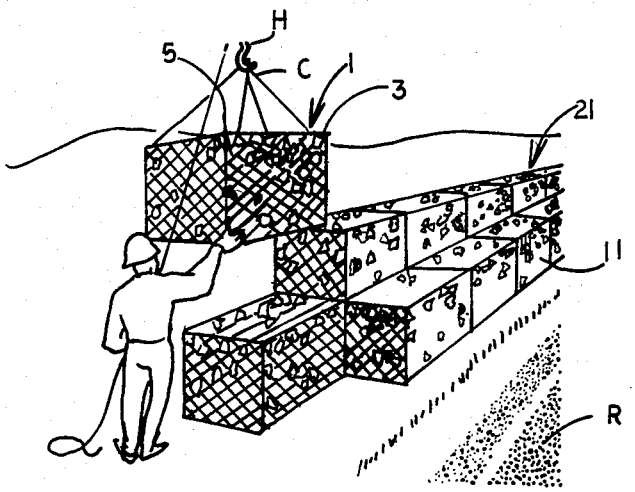
FIGURE 3
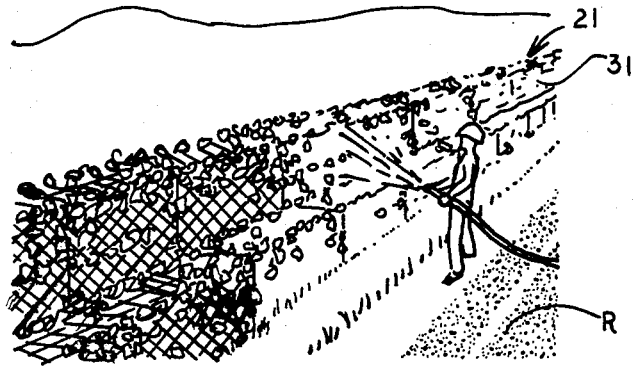
FIGURE 4
FIGURE 5
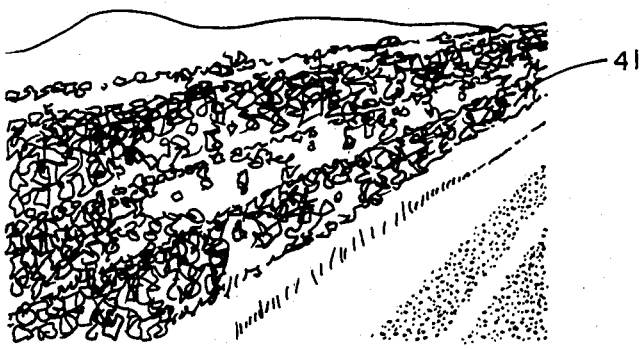

SOUND BARRIER

BACKGROUND OF THE INVENTION

This invention relates to sound barriers, and in particular to sound barriers such as for use along roadways, runways and the like.

A variety of sound barriers for reducing the transmission of the sound of motor vehicles and the like from vehicular paths are known. Such barriers involve the employment of plain walls made of concrete or wood, walls incorporating baffles, louvres channels and cavities, and constructions incorporating sound absorbing materials such as plastic foam, sponge and fibers. The following U.S. Pat. Nos. disclose the preceding types of sound barriers: 3,630,310 (plastic foam), 3,656,576 (fiber), 4,069,768 (hollow channels), 4,094,379 (foamed plastic, fiber, sponge rubber, glass fiber etc.), 4,095,669 (chambers), 4,111,081 (filament mats), 4,156,476 (cavities) and 4,158,401 (cavities). Each of the devices disclosed in the foregoing patents includes complex constructions using very specialized materials which are therefore inherently costly. Moreover, they are of such construction that they would tend to be seriously damaged if struck by a vehicle, leading to expensive repairs of the barrier; and they are not equipped with protective material for the sake of protecting errant vehicles. In fact, there has heretofore not been an effective sound barrier for use along roadways, runways and the like which is inexpensive to manufacture, highly resistant to impact damage, protective to vehicles striking the barrier and effective in use.

Devices known as gabions have been in use for centuries. Gabions are essentially wire cages filled with stone and used as retaining walls along slopes and waterways, revetments for causing the earth to stand at a slope steeper than it normally would assume, drop structures or weirs for retarding water flow velocity to control erosion, spurs, spur dikes and groins for establishing normal water channel width, and channel linings, etc. However, despite the use of gabions since ancient times, gabions have not been used as sound barriers.

SUMMARY OF THE INVENTION

A general object of the present invention is to provide an improved sound barrier against the noise of engines and other machines, such as vehicle motors.

A more particular object is to provide a sound barrier for use along roadways, runways and the like.

Another object is to provide a sound barrier for use along roadways, which reduces the likelihood of death and injury to occupants of, and damage to, vehicles striking the barrier.

Yet a further object of the invention is to provide a sound barrier which is attractive.

A further object is the provision of an improved sound barrier which is effective in use, economical to build and efficient in operation.

The foregoing objects are achieved according to the preferred embodiment of the invention by the provision of gabions filled with crushed stone and with other sound dispersing and absorbing materials and resilient materials such as rubber, rubber-like plastic, and the like which is protective to vehicles striking the barrier. These gabions can be stacked and arranged along the sides of the roadway, runway and the like according to the shape of the respective pathways, to a height dependent upon the size of the gabions and the height of the area relative to the pathway which is to be protected from the unwanted noise.

BRIEF DESCRIPTION OF THE DRAWINGS

FIGS. 3–5 are perspective views showing sequential stages of the assembly of a sound barrier according to the invention.

DESCRIPTION OF THE PREFERRED EMBODIMENT

A sound barrier according to the invention is composed of one or more gabions filled with sound absorbing and/or resilient material, and optionally with a ballast such as rock for adding stability and durability to the device. (The term "sound barrier" as used herein means one or more gabions containing materials for absorbing and/or dispersing sound; the term "sound barrier system" means a plurality of such gabions to form an entire sound barrier structure such as one extending along a stretch of highway). The gabion includes a container in the form of a rectangular, prismatic wire cage made of a strong, durable material such as galvanized steel, possibly covered with plastic sleeving or coating.

Figure 1:
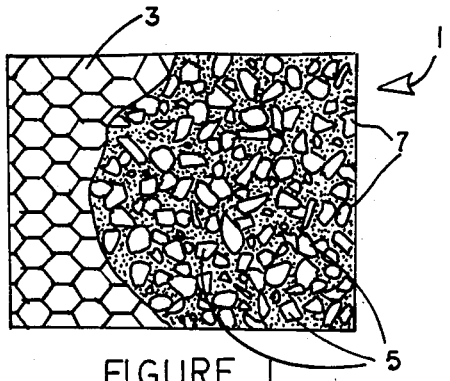
FIGS. 1 and 2 are partially sectioned end views of sound barriers according to the invention.

Thus, referring to FIG. 1, a gabion 1 is shown which includes a cage 3 filled with stones 5 and sound absorbing material such as shredded polystyrene foam 7. The stone is preferably in the core and base of the respective gabions to stabilize the devices, and to put the sound absorbing materials near the surface so that they can perform their function. (The stone does disperse incident sound waves). The cages can usually be filled at the site where they are to be employed. Often, stones are available at the site, but the other filler materials would probably have to be delivered.

Figure 2:
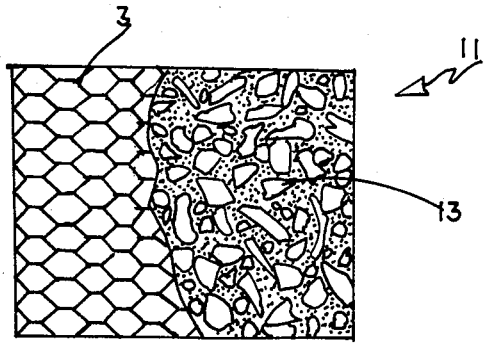

Gabions forming the sound barrier of the invention which are located near the roadway, runway or the like which are in the potential path of vehicles leaving the roadway or runway are partially or entirely filled resilient material to cushion the impact of any vehicles striking the gabion to reduce damage or injury. Turning to FIG. 2 a gabion 11 is shown which is composed of a cage 3 filled with a resilient material such as shredded vehicle tires 13 which are preferably made from tires no longer useable as such. Stone or other ballast, and/or sound absorbing material can be contained in cage 3 but preferably at the portions of the cage which are not in the potential impact area of errant vehicles.

FIGS. 3–5 depict the assembly of individual gabions to form a long sound barrier system 21 along a roadway R. The sound barrier includes a rearward row (relative to roadway R) of stacked gabions 1 filled with stone and sound absorbing material as discussed above, and a forward row of gabions 11 filled with resilient material 13. Gabions 11 are in the potential path of vehicles leaving roadway R.

In constructing the sound barrier system, gabions 1 and 11 are first filled with their respective contents. This operation can be done on site or elsewhere depending on the availability of materials. Since the gabions are preferably very heavy to withstand possible vehicle impacts, to assure their stability, and to reduce the likelihood of vandalism or theft, they are preferably positioned and stacked by a crane or the like as shown in FIG. 1. A workman is shown guiding a gabion 1 suspended on a hook H by means of support cables C, to a position stacked on the seated gabion nearest the workman.

The sound barrier system can be treated to render it aesthetically pleasing and in harmony with its surroundings. For example, an adhesive coating 31 could be sprayed on the outer surfaces of the sound barrier system 21 as shown in FIG. 4, which could then be covered with artificial plant life 41 as shown in FIG. 5. The coating 31 could alternatively be a plant growth promoting material such as a mixture of water, soil and plant nutrients, and plant life 41 could be natural plants such as an appropriate ivy, vines or the like.

Although FIGS. 3–5 illustrate a two-tiered stacked arrangement of gabions to form the sound barrier system, other arrangements are possible according to the size of the gabions, the terrain on which they are to be placed, and the overall height and length of the sound barrier desired.

Sound barriers according to the invention perform their sound blocking function by reflecting sound towards the pathway, by dispersing incident sound waves and by absorbing sound. These are accomplished largely because of the tremendous surface area in the path of sound waves striking the barrier and the irregularities in those surfaces, as opposed to conventional barriers which essentially provide one or a few planar surfaces.

These sound barriers are extremely inexpensive to prepare, since the filler materials are of very low cost, the main expense normally involving the shredding of the shreddable components. The gabion cage can be obtained from commercial sources. It takes virtually no skill to fill the devices, and if damaged they can be repaired or replaced with ease. Moreover, they make a useful commodity out of often useless waste products such as worn tires and waste plastic foam.

The invention has been described in detail with particular emphasis on the preferred embodiment, but it should be understood that variations and modifications within the spirit and scope of the invention may occur to these skilled in the art to which the invention pertains.

I claim:

1. A sound barrier for reducing vehicular noise along vehicular pathways, said sound barrier comprising:

a wire gabion cage defining an interior chamber, said cage having a core section and a base section;

a first filler of stone disposed in said core section and in said base section for providing ballast to said sound barrier;

a second filler of resilient shredded vehicle tires disposed in said gabion cage about said core and base sections for absorbing sound and for cushioning the impact of vehicles striking the sound barrier.

* * * * *